United States Patent [19]

Templeton

[11] 4,452,416

[45] Jun. 5, 1984

[54] DISPLAY DEVICE

[75] Inventor: Michael S. Templeton, Simi, Calif.

[73] Assignee: Wayne K. Templeton, Simi Valley, Calif.

[21] Appl. No.: 341,513

[22] Filed: Jan. 21, 1982

[51] Int. Cl.[3] ..... A47B 97/02

[52] U.S. Cl. ..... 248/447.2; 248/451; 40/606; 24/567 SL

[58] Field of Search ..... 248/441 B, 441 R, 441 C, 248/461, 229, 226.5, 451, 316 D; 312/D33, 230; 24/255 SL, 255 R, 252 R, 251, 253, 243 K; 40/312, 606; D14/88, 86, 90, 89; 343/795, 794, 702, 747, 823

[56] References Cited

U.S. PATENT DOCUMENTS

| | | | |
|---|---|---|---|
| D158233 | 4/1950 | Trowbridge | D14/88 |
| 751,408 | 2/1904 | Pettit | 248/441 C |
| 2,531,003 | 11/1950 | Slaker | 24/253 |
| 2,895,130 | 7/1959 | Klancnic, Jr. | 343/702 |
| 2,930,156 | 3/1960 | Jones | 248/229 |
| 3,363,255 | 1/1968 | Neenaber | 343/795 |
| 3,418,740 | 12/1968 | Gray | 248/351 |
| 3,955,249 | 5/1976 | Shiozaki | 24/251 |
| 4,115,966 | 9/1978 | Delee | 248/229 |
| 4,191,354 | 3/1980 | Chialiu | 248/451 |
| 4,247,076 | 1/1981 | Larkin | 24/255 SL |

*Primary Examiner*—Reinaldo P. Machado
*Assistant Examiner*—Alvin Chin-Shue
*Attorney, Agent, or Firm*—Roger A. Marrs

[57] ABSTRACT

A display device is disclosed herein for releasably holding graphic or other materials or articles including a U-shaped base adapted for supporting attachment to a tool box, table or the like and the base retaining a pair of material or article support rods having one end of each rod secured to the base. The pair of rods upwardly extend in diverging relationship and slidably support a spring biased clip on each rod for releasably retaining the materials or articles intended to be displayed.

2 Claims, 5 Drawing Figures

FIG. 1
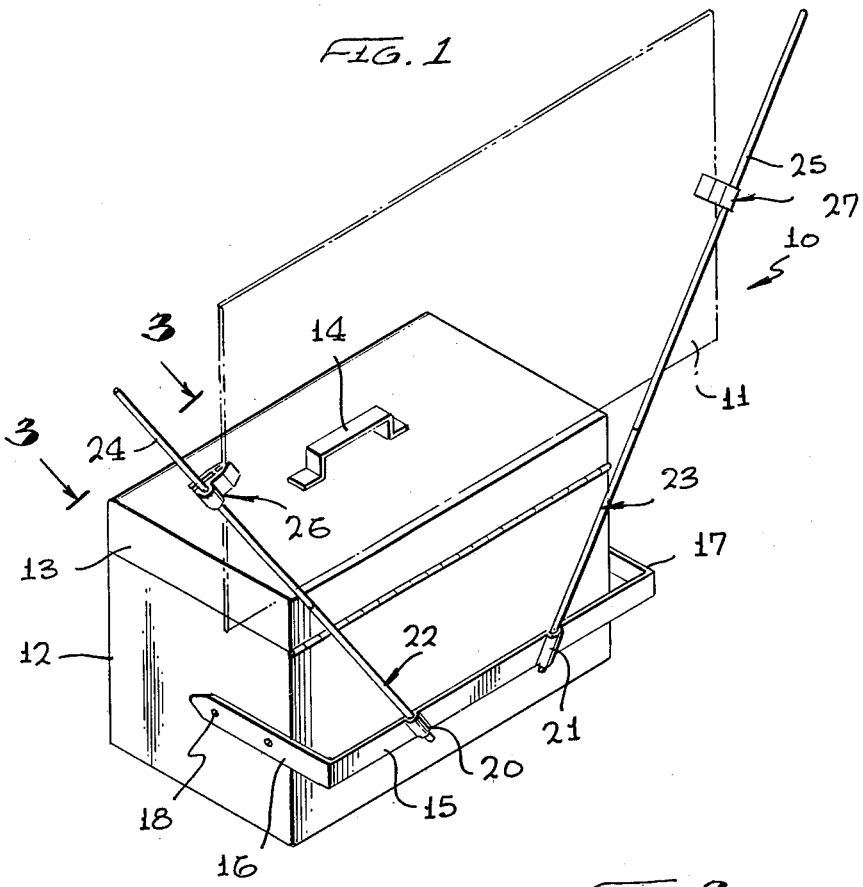
FIG. 5
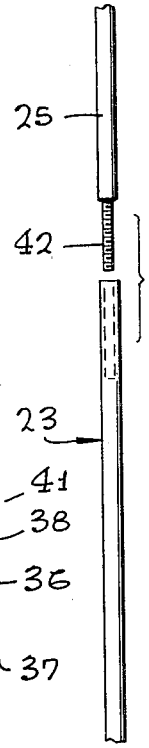
FIG. 3
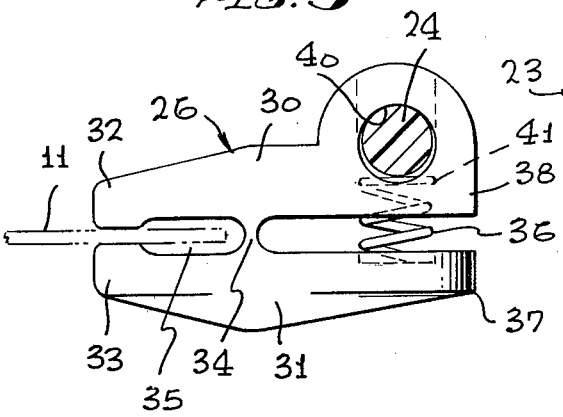
FIG. 2
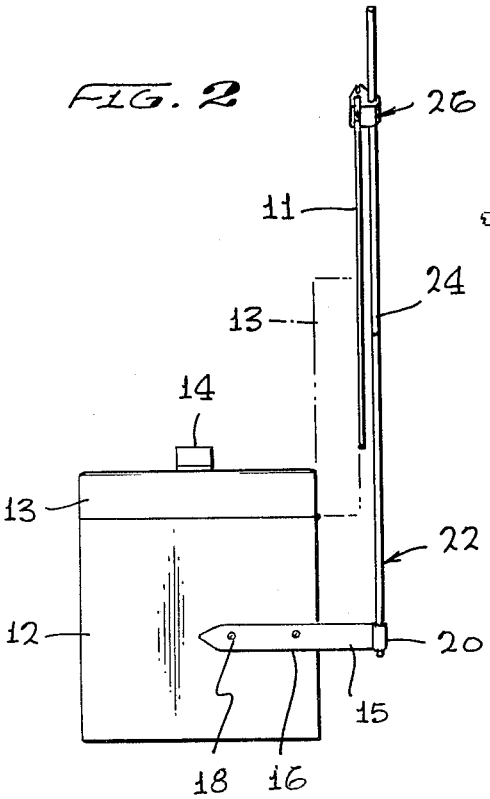
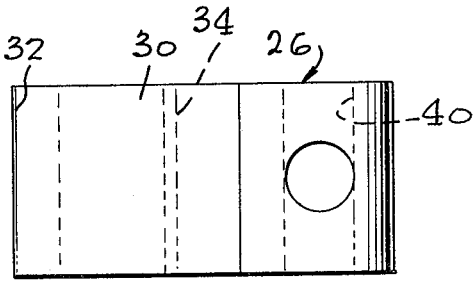
FIG. 4

DISPLAY DEVICE

BACKGROUND OF THE INVENTION

1. Field of the Invention

The present invention relates to display devices and more particularly to a novel device for releasably supporting graphic or other materials or articles intending to be displayed in areas or locations having restricted access and supporting area.

2. Brief Description of the Prior Art

In the past, it has been the conventional practice to display graphic materials, messages, photographs and other materials and articles from display stands which are rather bulky and which require a sizable area for support. In some instances, items such as blackboards and magnetic mounting boards are used. for releasably supporting materials intending to be displayed and these latter devices also suffer from the above problem.

More immediate problems are encountered by workmen which require frequent reference to materials such as blueprints or drawings so that workpieces can be properly produced on machines. Usually, such drawings or prints are unfolded and laid out on a flat table and the workman has to constantly change his attention from the workpiece to the print and then back to the workpiece. Also, there usually is not suitable hold down or retaining device for maintaining the unfolded print in a spread-out condition. The workman frequently will use tools or other weighted objects placed on the corners of the print for hold down purposes. Obviously, such procedures are awkward and do not represent a savings of time or convenience to the workman.

Therefore, a longstanding need has existed to provide a display device that may be readily incorporated into a workman's area which will conveniently support or hold graphic materials such as blueprints in a convenient location so that the workman need only glance for a moment to obtain the information contained thereon and to continue working on the workpiece.

SUMMARY OF THE INVENTION

Accordingly, the above problems and difficulties are obviated by the present invention which provides a novel display device incorporating a base means for securement to a supporting structure and which further includes a pair of diverging rods having one end attached to the base means and having free outwardly extending ends against which the material intended to be displayed is supported. Clip means slidably carried on each of the rods in the pair are employed for releasably holding the materials or articles in an unfolded or laid out condition. Each of the clip supports includes a pair of jaws having a central pivot point whereby one of the jaws includes material or article engaging means while the other jaw includes a spring means for biasing the first mentioned jaws into a closed position about the material or article intending to be displayed. The spring means also exerts a pressure or bias against the rod to which the clip is attached so that a yieldable force is supplied for holding the clip in a preferred position.

Therefore, it is among the primary objects of the present invention to provide a novel display device for releasably supporting materials and articles intended to be displayed whereby the device may be supported in a convenient area from suitable supporting structure.

Another object of the present invention is to provide a novel clip means for releasably engaging and retaining the materials or articles intending to be displayed while suspended from a display device.

Yet another object of the present invention is to provide a novel display device incorporating clip means that may be readily mounted on a supporting device such as a tool box, work table or the like.

Still a further object of the present invention is to provide a novel cip means having a double jawed or yoked construction wherein one of the jaws incorporates a spring bias effective to close the other jaw against material or articles intended to be displayed and wherein the spring bias is also yieldably applied against a supporting structure so that the clip means may be slid along the supporting structure when desired.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

FIG. 1 is a perspective view of the novel display device incorporating the present invention and illustrated as being mounted on a conventional tool box;

FIG. 2 is a side elevational view of the display device shown in FIG. 1;

FIG. 3 is an enlarged cross-sectional view showing the clip means incorporated into the present invention as taken in the direction of arrows 3—3 of FIG. 1;

FIG. 4 is a top plan view of the clip means shown in FIG. 3; and

FIG. 5 is an exploded view of a support rod incorporated into the display device shown in FIGS. 1 and 2.

DESCRIPTION OF THE PREFERRED EMBODIMENT

Referring now in detail to FIG. 1, the novel display device of the present invention is shown in the general direction of arrow 10 for supporting a graphic medium or sheet material such as indicated by numeral 11. Preferrably, the graphic material may be a layout drawing of a workpiece or other blueprint or technical information pertaining to the construction and manufacturing of a workpiece. Inasmuch as the work area is rather limited in space, the device 10 is illustrated as being supported on a tool box 12 which includes a hinged lid 13 and a handle 14.

The display device 10 includes an elongated base 15 having opposite ends 16 and 17 which are wrapped about the tool box 12 and fastened thereto by any suitable means such as screws indicated by numeral 18. Therefore, it can be seen that the base is of a U-shaped configuration in plan view and further includes receptacles 20 and 21 for insertably receiving ends from a pair of support rods 22 and 23 respectively. The ends of the rods may be suitably crimped into or with the receptacles 20 or 21 or other suitable attachments may secure the ends thereto such as a threaded connection or by welding.

It is to be particularly noted that the rods 22 and 23 are arranged to outwardly extend from the base 15 in a diverging direction so that the display material 11 may be suitably supported and so that a variety of sheet material sizes can be accomodated.

A feature of the invention resides in the fact that the rods 22 and 23 are flexible so that they will readily bend or yield to pressure and that the rods are extendable such as by providing extensions 24 and 25 arranged in end-to-end relationship with respect to their support members. If desired, a telescoping arrangement may be provided so that the support rods can be adjusted to a desired height.

Clip means are provided on the ends of the support rods and such means are indicated by numerals 26 and 27 respectively associated with each of the support rods. The clip means are employed for releasably supporting the opposite edge marginal regions of the material intended to be displayed and a feature of the clip means resides in the fact that they are resiliently mounted on the support rods so they may be readily slid along the length of the support rods to any desired locations.

Referring now in detail to FIG. 2, it can be seen that the base means 15 is offset from the rear of the tool box 12 so as to accomodate the thickness of the lid 13 when it is pivoted to an open position as shown in broken lines. In this manner, ready access is provided to the tool box so that tools or other implements can be placed into or taken from the box without having to dismantle or be subjected to interference from the display device.

Referring now in detail to FIG. 3, clip means 26 is illustrated which may be described as a double yoke arrangement having a body 30 integrally formed with a jaw element 31 so as to provide a pair of jaws 32 and 33 in fixed spaced relationship with respect to an integral central pivot 34. A substantial opening is defined between the jaws 32 and 33 and the pivot 34 which is broadly identified by numeral 35. The jaws 32 and 33 include contacting surfaces which will abutt against one another unless material or an article is disposed therebetween such as the sheet of material 11 as illustrated. In order to urge the jaws members against the material, a spring 36 is provided which expands against a lever arm 37 of the jaw member 31 and against a rod engaging portion 38 formed with the body 30. As the spring 36 expands, portions 37 and 38 are forced away from one another and cause the jaw members 32 and 33 to come together against the material 11 as the jaw member 31 pivots with respect to the body 30 via pivot 34.

It can also be seen in FIG. 3 that the rod supporting portion 38 of the body 30 includes a hole 40 through which the rod 24 passes so that the clip means 26 may readily slide thereon. In order to provide a suitable retention for the clip means so that it may be located at any desired point along the length of the rod, the spring 26 bears against a pad 41 which, in turn, bears against a portion of the rod 24. Thereby, it can be seen that a yieldable spring pressure is applied by the spring 36 to the rod 24 via pad 41.

Referring to FIG. 5, it can be seen that the extension rod 25 may be readily attached to the support rod 23 by any suitable means such as a threaded connection indicated in general by numeral 42. Telescoping means can also be incorporated, if desired.

In view of the foregoing, it can be seen that the display device of the present invention provides a novel means for displaying graphic subject matter in a restricted area. Although the base means 15 may be attached to any suitable supporting structure, it is most common that the structure will by that of a tool box and that the display material will be a print or drawing of a part or work piece. The clip means 26 and 27 are novel in themselves and are particularly novel in the combination with the support rods 22, 23 and 24, 25. The clip means include a spring bias or resiliance means adapted to not only actuate the jaws 32 and 33 into a releasable holding action against the edge marginal regions of the sheet material 11 but provides a yieldable force against the rod 24 or 25 on which the clip means is slidably mounted. The tension is such so that the clip means will not slide unless forcably urged by the user to a desired location. Once the location has been reached, the resiliant bias will maintain the clip means in the desired position.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A display device for mounting on a support structure comprising the combination of:

an elongated base adapted for securement onto the supporting structure;

a pair of support rods fixly carried on said base between its opposite ends so as to upwardly project therefrom in diverging relationship;

spring biased clip means slidably carried on each of said pair of support rods adapted to releasably retain materials or articles intended to be displayed;

each as said support rods comprise at least two rods arranged in telescoping slidable relationship so as to be selectively extendable and retractable to desired lengths;

said pair of support rods are flexible and bendable to desired orientation;

said clip means includes a pair of jaw members joined at their mid-sections to provide a pivot connection;

spring means disposed between opposing jaw ends to normally bias the opposite jaw ends together via said pivot connection to effectively grip the materials or article intended to be displayed;

said clip means further includes an enlarged portion disposed on one end of a selected jaw;

said enlarged portion provided with a hole for slidably receiving said supporting rod associated therewith; and said spring means comprising an expansion helical spring compressed between said associated supporting rod and said jaw opposite to said jaw provided with said hole so as to place a yieldable pressure against said supporting rod and to pivot said jaws on the opposite end of said body to about said pivot connection to effect a releasable closure therebetween.

2. A resilient clip comprising a body having two elongated members joined at their mid-section with an integral pivot connection so as to define a jaw between opposing end surfaces of one end of said body and biased yoke defined by the opposing ends surfaces of the other end of said body;

a selected member of said two elongated members provided with an open-ended mounting hole in said biased yoke;

said selected member having an open-ended second hole normal to said first hole exposed with said first hole and to the opposing surface of said non-selected member of said biased yoke; and a compressed spring carried in said second hole bearing against said opposing surface of said non-selected member of said biased yoke and a support article occupying said first hole.

* * * * *